US005087344A

United States Patent [19]

Wenske et al.

[11] Patent Number: 5,087,344

[45] Date of Patent: Feb. 11, 1992

[54] ELECTROLYSIS CELL FOR GAS-EVOLVING ELECTROLYTIC PROCESSES

[75] Inventors: Hanno Wenske; Arnold Gallien, both of Grimma; Wolfgang Hanke, Leisnig-Tragnitz; Wolfgang Lampe, Grimma; Lothar Illgen, Dresden, all of Fed. Rep. of Germany

[73] Assignee: Heraeus Elektroden GmbH, Hanau, Fed. Rep. of Germany

[21] Appl. No.: 588,359

[22] Filed: Sep. 26, 1990

[51] Int. Cl.[5] ..... C25B 9/00; C25B 11/02; C25B 11/03; C25B 15/08

[52] U.S. Cl. ..... 204/256; 204/258; 204/266; 204/270; 204/272; 204/283; 204/284

[58] Field of Search ..... 204/270, 284, 252-258, 204/263-266, 283, 272

[56] References Cited

U.S. PATENT DOCUMENTS

| | | | |
|---|---|---|---|
| 3,113,918 | 12/1963 | Evans | 204/270 X |
| 3,835,209 | 9/1974 | Galneder | 204/270 X |
| 4,022,679 | 5/1977 | Koziol | 204/219 |
| 4,194,961 | 3/1980 | Williams | 204/270 X |
| 4,379,742 | 4/1983 | Rathgen | 204/286 |
| 4,389,298 | 6/1983 | Pellegri | 204/288 |
| 4,422,919 | 12/1983 | Fabian | 204/270 |
| 4,457,816 | 7/1984 | Galluzzo et al. | 204/270 X |
| 4,557,818 | 12/1985 | Roos | 204/288 |
| 4,695,355 | 9/1987 | Koziol | 204/252 |
| 4,747,925 | 5/1988 | Hasebe et al. | 204/270 |

*Primary Examiner*—Donald R. Valentine

*Attorney, Agent, or Firm*—Frishauf, Holtz, Goodman & Woodward

[57] ABSTRACT

An electrolysis cell for gas-evolving electrolytic processes using at least one electrode having electrode elements arranged parallel is described; the electrode elements have a thickness of up to three times the mean bubble separation diameter and have a capillary gap with respect to one another such that a motion of the gas bubbles through the electrode is brought about substantially in the direction or in the opposite direction of the electric field between the reaction surfaces of the anode and cathode.

16 Claims, 6 Drawing Sheets

ELECTROLYSIS CELL FOR GAS-EVOLVING ELECTROLYTIC PROCESSES

Figure 1:
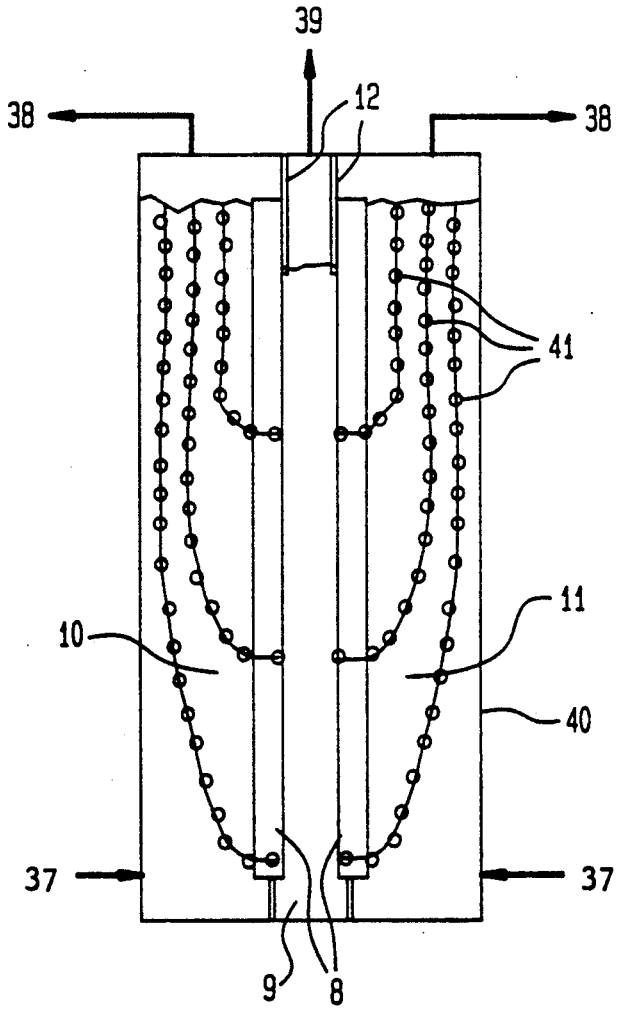

Cross-reference to related U.S. patents and applications, the disclosures of which are hereby incorporated by reference:

U.S. Pat. No. 4,422,919, FABIAN et al./HERAEUS, issued Dec. 27, 1983;

U.S. Ser. No. 755,324, FABIAN et al., filed June 24, 1985, now abandoned, and its continuation, U.S. Ser. No. 873,115, FABIAN et al., filed June 10, 1986, now abandoned, both corresponding to PCT/EP 84/00335;

U.S. Pat. No. 4,022,679;

U.S. Pat. No. 4,389,298;

U.S. Pat. No. 4,557,818, ROOS et al./BASF AG, issued Dec. 12, 1985;

U.S. Pat. No. 4,695,355, KOZIOL/CONRADTY GmbH, issued Sept. 22, 1985; issued Apr. 12, 1983.

Cross-reference to related foreign patent documents:

GB 2,180,556, SHIMAMUNE/PERMELEC ELECTRODE LTD, July 19, 1989, corresponding to German DE-OS 36 25 506, publ. Feb. 5, 1987;

West German DE-AS 12 71 093;

East German Patent 250 026;

West German DE-OS 27 35 238.

The invention relates to an electrolysis cell for gase-volving electrolytic processes which is particularly suitable for use in water and chlor-alkali electrolysis.

For the production of various important basic chemical materials, such as caustic soda, chlorine, hydrogen or hydrogen peroxide, gas-evolving electrolytic processes are of outstanding importance. The electrodes, both anodes and cathodes, to be used in the electrolysis of alkaline solutions, water, and hydrochloric or sulfuric acid must meet a number of sometimes contradictory usage parameters. One very essential requirement is the rapid removal of the evolved gas from the space between the anode and the cathode, in order to avoid a large gas proportion that increases the electrical resistance of the electrolyte. However, this conflicts with the attempt to make maximum use of the available structural surface area for an electrochemically active electrode surface.

The attempt is also made to have the electrode surface be as uniform and finely structured as possible, to meet the prerequisites for a homogenous electrical field. Discontinuities, such as edges, cause increases in field intensity and thus cause an uneven electrode load, resulting not only in energy losses but also in premature wear of the electrode material or electrocatalytic coating.

To separate the gases formed at the electrodes, membranes or diaphragms are used. These separating elements have a relatively high ohmic resistance, so that the gas separation is achieved at the cost of high energy expense.

Another essential factor to assure an optimal process is to achieve a uniform, small electrode spacing, without putting major mechanical strain on membranes, if used, or even damaging them. Electrode elements of great thickness should also avoid exerting high contact pressure upon the membrane, which would notably hinder the electrolyte flow or ion transport through the pore system of the membrane.

Two important basic types of gas-evolving metal electrodes are known: On the one hand, profiled parallel bars which are circular, elliptical, teardrop-shaped, or rectangular in cross section and are supported by current distributors are used (West German Patent Disclosure Documents DE-OS 30 08 116 and 33 25 187; West German Patent 3 519 272; and West German Patent Disclosure Document DE-OS 35 19 573). U-shaped, spaced-apart aligned rails, however, are also known, from West German Examined Patent Application DE-AS 12 71 093.

On the other hand, perforated metal sheets with slits that extend vertically and horizontally, with segments that are deepdrawn or angled relative to the electrode plane, perforated metal sheet electrodes, and expanded metal mesh electrodes, are also known (East German Patent 250 026, and West German Patent Disclosure Documents DE-OS 36 25 506 and 27 35 238).

Examples of the first basic type use parallel electrode elements, which are firmly connected to current distributor rails and have a teardrop-shaped cross section (DE-OS 33 25 187) or an approximately circular cross section (DE-OS 30 08 116). The circular cross section was modified by cutting off segments that are located in the electrode plane. Both electrodes are intended preferentially for use in chlor-alkali electrolysis in amalgam cells. These electrodes have no substantially reduced degree of coverage of gas bubbles. The removal of the gas is effected solely by the fluid flow and by buoyancy. The particular crosssectional geometries are not suitable to take on an active role in gas transport through the electrode. Although by avoiding irregularities they prevent an overload on the catalytic coating, nevertheless this is done at the cost of the disadvantages of the uneven spacing of the electrode faces, dictated by the radius.

DE-OS 35 19 272 discloses an electrode structure that has a plurality of parallel electrode elements of rectangular cross section. A plate-like support with indentations on both sides secures the electrode elements and serves as a current distributor. The cross section of the rectangular electrode elements is intended to have a ratio of 1:5. To prevent the gas removal lugs in the vicinity of the gap from coming into contact with one another and causing turbulence, a relatively large gap between adjacent electrode elements is provided. This results in relatively low utilization of the available structural surface area and causes an uneven electrode load, particularly in the vicinity of the edges of the rectangular profiles, where increased wear of the catalytic coating must be expected. The selected shape of the support for the electrode elements, which at the same time is a current distributor, prevents the concentration of the gas in the space on the other side of the reactive electrode face. The result is a high gas proportion in the region of the reaction face, associated with increased electrical losses.

The electrode disclosed in DE-OS 35 19 573 is quite similar to the electrode structure described above. It likewise comprises electrode elements of rectangular cross section, disposed parallel on a current distributor and spaced apart from one another by several millimeters. The face ends of the electrode elements oriented toward the membrane also have a number of recesses. The webs located between them are not electrocatalytically coated and rest on the membrane. The available reactive surface area is thus only about 10% of the membrane surface area. Because of relative motions between the electrode and the membrane, the webs may cause local damage to the membrane.

The object of the invention is to develop an electrolysis cell for gas-evolving electrolytic processes having substantially altered performance parameters. It should enable a significant reduction in the ohmic power losses and thus an increase in the specific electrical load on the electrodes; nevertheless, however, the degree of gas enrichment at the electrode faces is intended to be reduced considerably, despite the increased gas production. Specifically, the following objects are to be attained:

Reducing the burden of gas bubbles in the electrolyte between the electrodes and the degree of coverage of gas bubbles on the reaction faces of the electrode;

the electrode structure is intended to assure an aligned gas transport during the process;

improvement of the ratio of active electrode surface area to structural surface area;

lessening the increase in local field intensity and development of an approximately homogenous electrical field, to make the load on the electrode surface area available for reaction more uniform.

The novel electrolysis cell is intended to have gas-separating properties, thus making it unnecessary to use gasseparating means (such as membranes, diaphragms or the like).

The electrode spacing should not be increased.

According to the invention, this object is attained by an electrolysis cell for gas-evolving electrolytic processes, in particular for water and chlor-alkali electrolysis, having at least one electrode comprising electrode elements arranged parallel and forming an anode and cathode, by providing that the electrode elements have a thickness of only up to three times the mean bubble separation diameter and that they have a capillary gap with respect to one another such that the direction of motion of the gas bubbles through the electrode is substantially in the direction and in the opposite direction of the electrical field between the reaction surfaces of the anode and cathode. The invention is intended to encompass electrolysis cells that are made up of electrode structures with quasi-parallel electrode elements forming a capillary gap, as is the case for instance for a spirally wound electrode, as well.

The bubble separation diameter is the diameter of a bubble, as it leaves its nucleus, under existing actual process conditions at an electrode of the type according to the invention. By definition, a bubble leaving its nucleus is also one that moves by adhesion on the electrode surface.

The separation diameter of gas bubbles is known to depend to a considerable extent on the type of electrolysis and on the process conditions. According to the journal Elektrochimika Acta, Vol. 33, No. 6, pp. 769–779, 1988, the following bubble diameters can be expected under typical electrolysis conditions:

For hydrogen: approximately 8 μm

For oxygen: approximately 17 μm

For chlorine: approximately 110 μm

An electrolysis cell according to the present invention assures that the capillary action of the electrode, beginning at the region between the electrode elements, also affects the bubbles formed on the mostly rounded end faces, and aspirates them into the capillary gap even if some spacing has been left between the electrode and the membrane. Advantageously, the electrode elements are blades, strips or foils with a maximum thickness of 450 μm. The width of the electrode elements is substantially greater than their thickness and is at least 10 times the width of the capillary gap. As a result, a capillary system that acts two-dimensionally is created in the electrode, which prevents the introduction of turbulence from the degassing chamber of the electrolyte into the reaction chamber between the electrode and the membrane. This precludes influence on or disturbance of the bubble forming process and bubble transport into the capillary gap. The gas transport through the electrode takes place in aligned fashion, substantially transversely to the electrode plane, across the very short path corresponding to the width of the electrode elements. The reason for this is the considerable relative increase in volume in the reaction chamber because of the bubble forming process. This causes a pressure increase and a positive displacement reaction there. To the same extent as the gas is positively displaced out of the reaction chamber and the electrode, electrolyte flows without turbulence through the capillary gap to the reactive surfaces of the electrode. The high degree of electrolyte exchange prevents ionic depletion of the electrolyte, even in its boundary layer, since because of the capillary forces, the liquid transport takes place directly at the electrode surface. The characteristic flow conditions in the capillary gap prevent vertical motion of the gas bubbles to the maximum possible extent.

To achieve the principle of the electrolysis cell according to the invention, two variant electrodes prove to be particularly advantageous. Folding endless material of large surface area on alternate sides enables economical production of capillary gap electrodes; all the necessary operations such as perforations, profiling and coating are suitably performed beforehand in a continuous process. These perforations in the region of the folded edges are suitably distributed uniformly. For defining the capillary gap, the electrode elements have profiled sections. Those that have a web-like structure extending transversely to the electrode plane have proven themselves; knob-like or button-like profiled sections have also proved to be useful. Stacking of electrode elements profiles in accordance with the invention is also suitable for producing capillary gap electrodes. The profiled sections generated in the initial forming process or by subsequent deformation define the capillary gap and make separate spacers unnecessary.

The lower limit to the thickness of the electrode elements is determined solely by processability, mechanical stability and manipulability of the material, or in other words in the final analysis by the type of material.

In order to enable full exploitation of the advantageous of the novel electrolysis cell, it is advantageous to seal off both the electrode elements that laterally define the electrode and the lower closure of the electrode toward the inner wall of the cell housing, except for a gap that at most is equivalent to the capillary gap. The degassing chambers in the upper cell region are also closed off in gas-tight fashion by a bulkhead, which extends at least as far as the lowest possible level of the liquid electrolyte in the reaction chamber. This prevents mixing of the gases that rise in the degassing chambers of the electrolysis cell.

When this kind of cell construction is used for water electrolysis, in other words a process that does not require separation of the anolyte and catholyte, the use of a gas separating system such as a diaphragm may be unnecessary, or may permit the use of a comparatively large-pored element, which optionally may merely fix the electrode spacing, having a negligible Ohmic resistance.

To prevent coagulation of gas bubbles that arise at oppositely poled electrodes, a spacing that at least corresponds to three times the bubble separation diameter must be provided between the electrodes. This characteristic counteracts contamination of the gas bubbles rising in the degassing chambers and also counteracts the formation of mixed- gas in the reaction chamber caused by coagulation of gas bubbles.

An advantageous variant of the invention for use in water electrolysis, or in other words where the anolyte and catholyte are identical, uses a dielectric electrolyte-proof spacer element between the anode and cathode; this element may in particular have the structure of a net, honeycomb, or wide-mesh woven fabric. In accordance with its thickness, the spacer element assures the fixation of the anode and cathode with short spacing, which is secure against short-circuiting. The great flexibility of the electrode structure, which can withstand heavy mechanical loads, assures a uniform electrode spacing on all sides. Moreover the reaction chamber is divided by the spacer element into a plurality of small reaction cells. Disturbances caused by the flow, and the formation of mixed gas, can virtually no longer occur.

The advantages of the electrodes comprising electrodes of elements according to the invention having a capillary gap arrangement are as follows:

- Very small gas bubble burden of the electrolyte in the reaction chamber because of an aligned gas bubble transport within the capillary gap electrode;
- an electrode structure of high packing density that is uniformly and finely structured and is permeable to gas and liquid
- as a result: uniform current load and exploitation of the available reaction surface area, no local erosion of the electrode surface, in particular of the electrocatalytic coating; and
- mechanically loadable yet flexible and thus conforming electrode structure; no stringent requirements in terms of flatness, rejection of defective elements, and the like.

Figure 2:
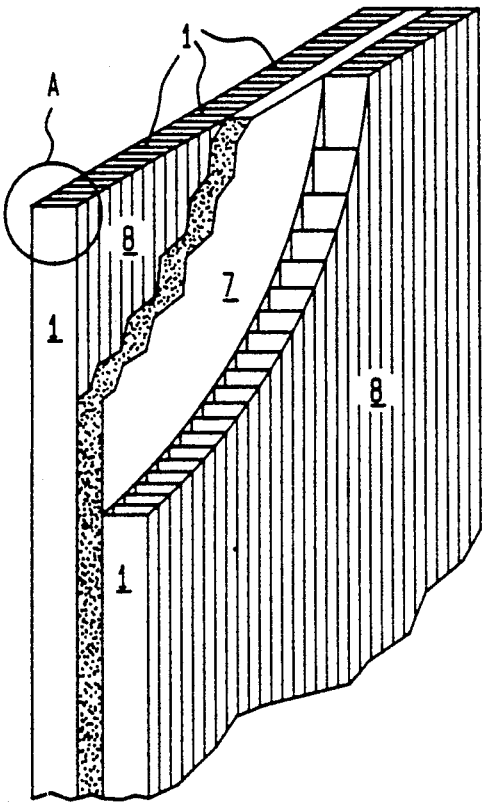
Figure 3:
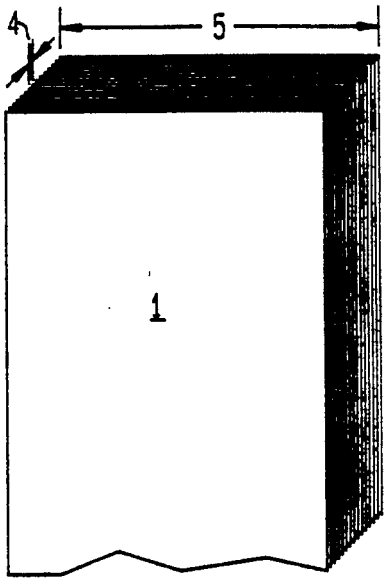
Figure 4:
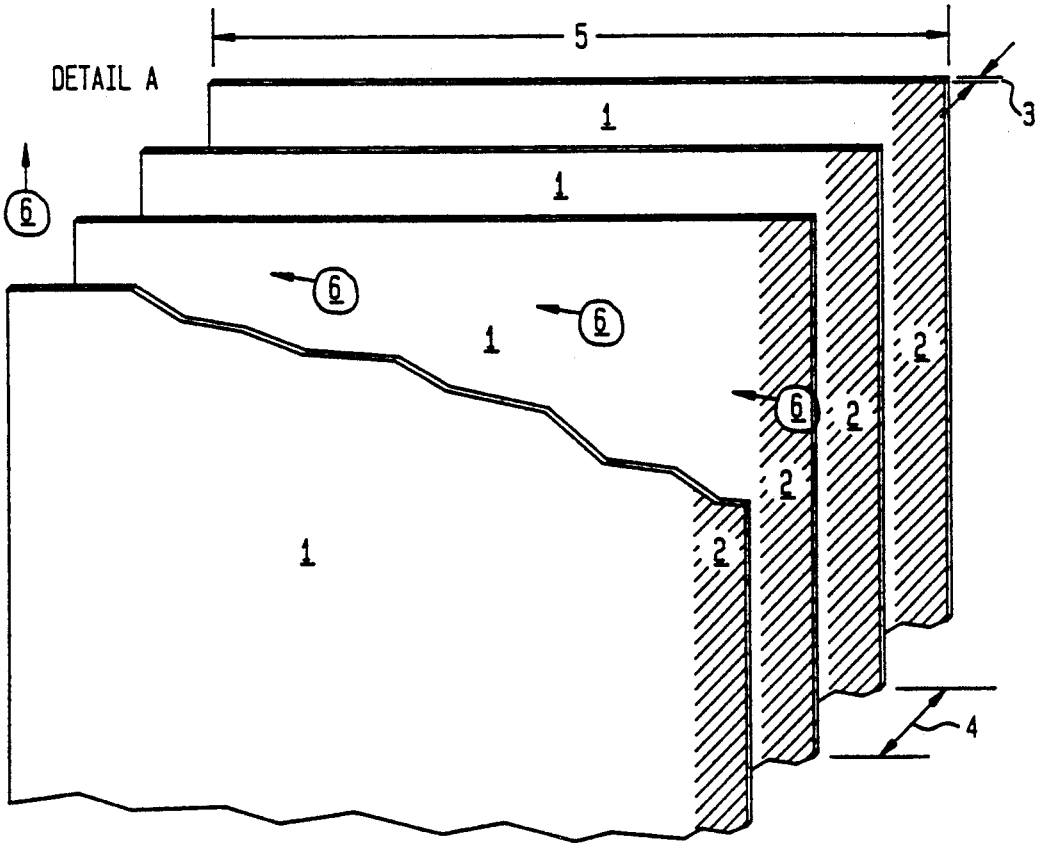
Figure 5:
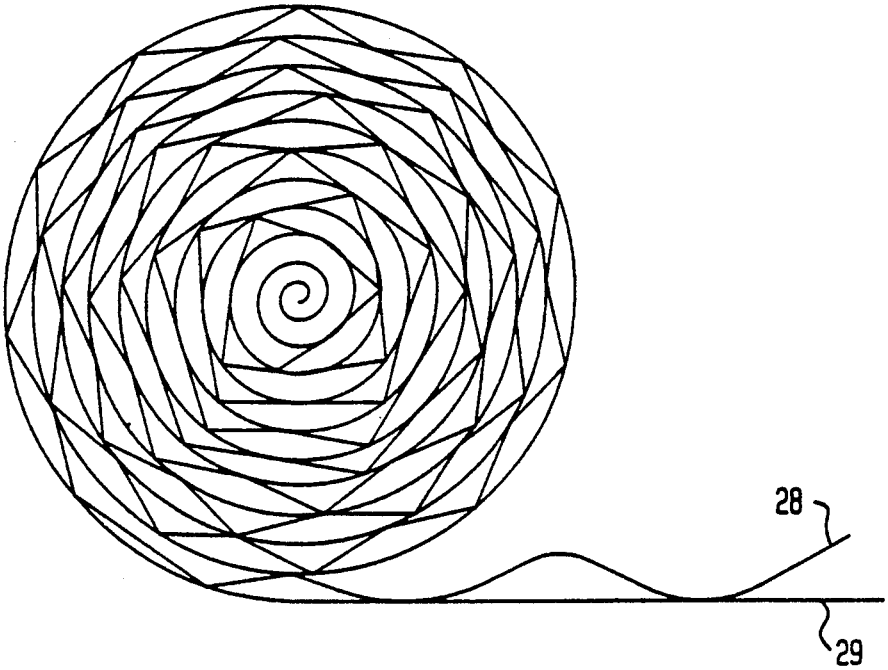
Figure 6:
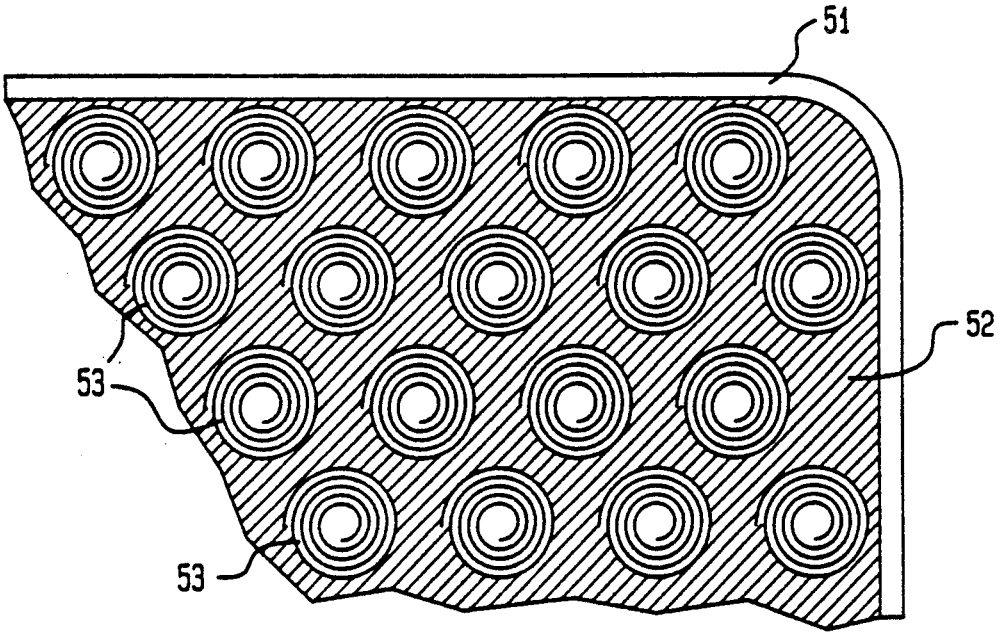
Figure 7:
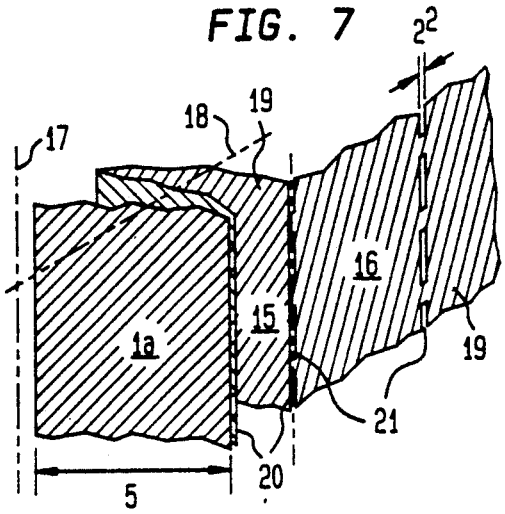
Figure 8:
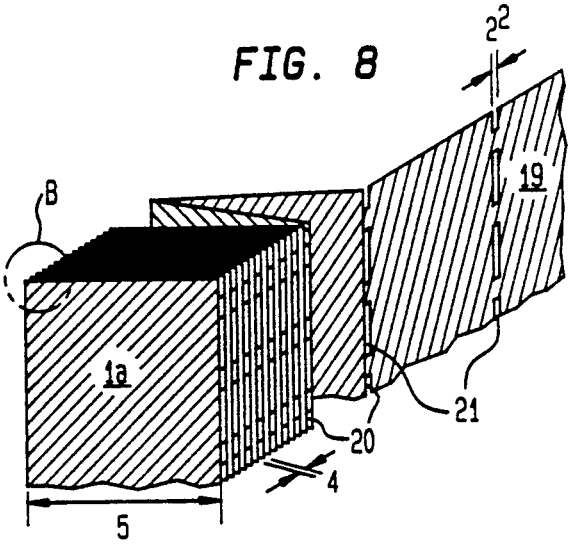
Figure 9:
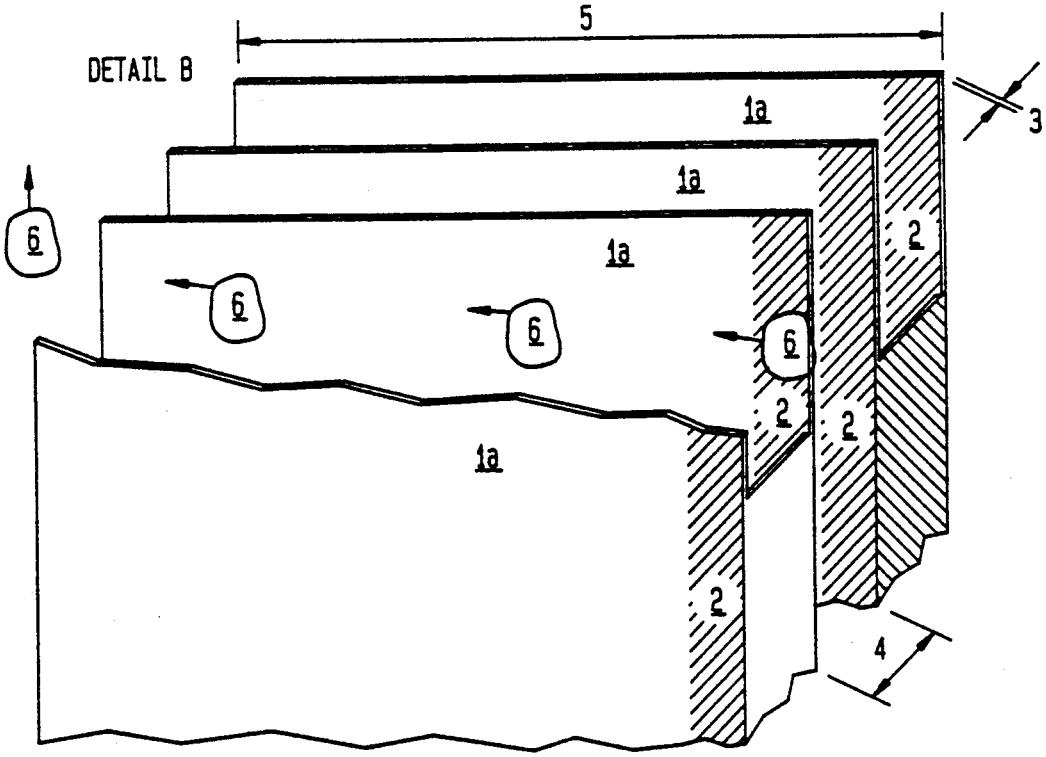
Figure 10:
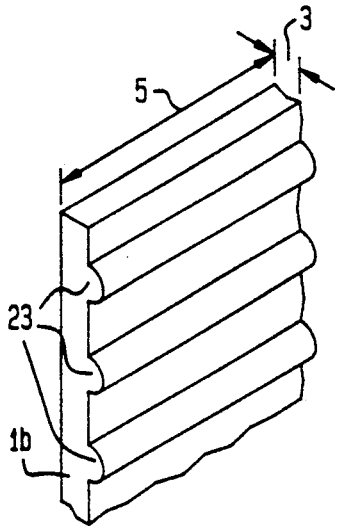
Figure 11:
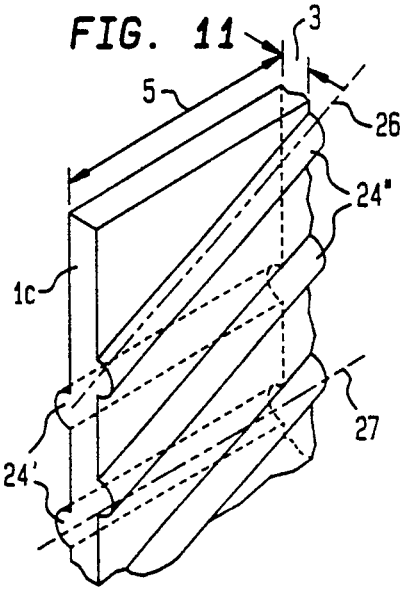
Figure 12:
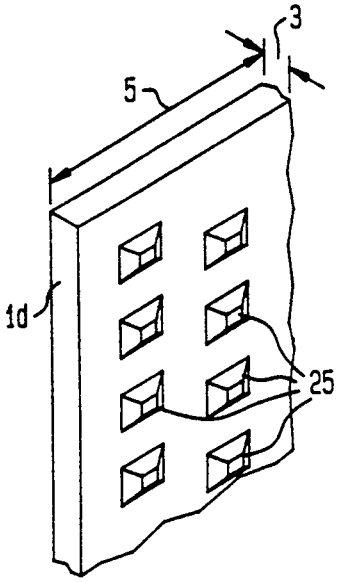
Figure 13:
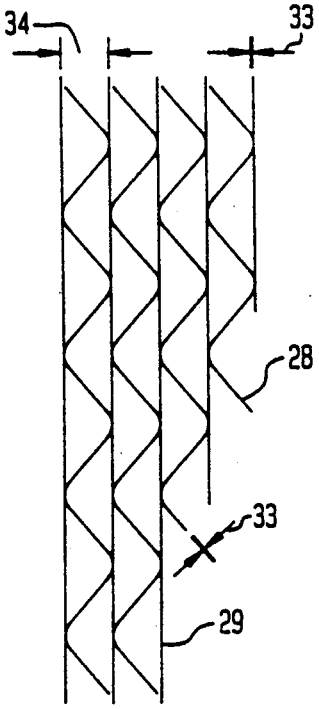
Figure 14:
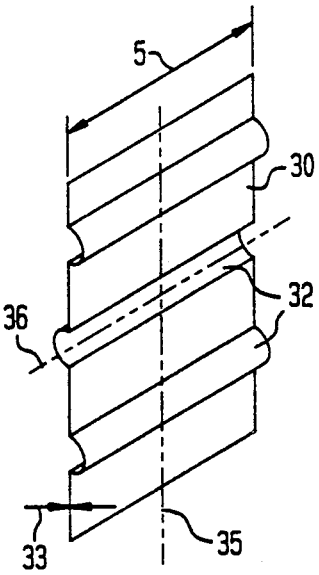
Figure 15:
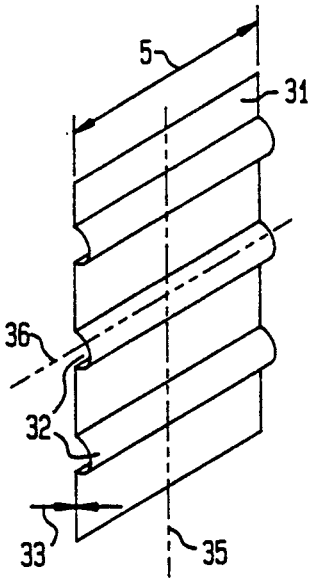
Figure 16:
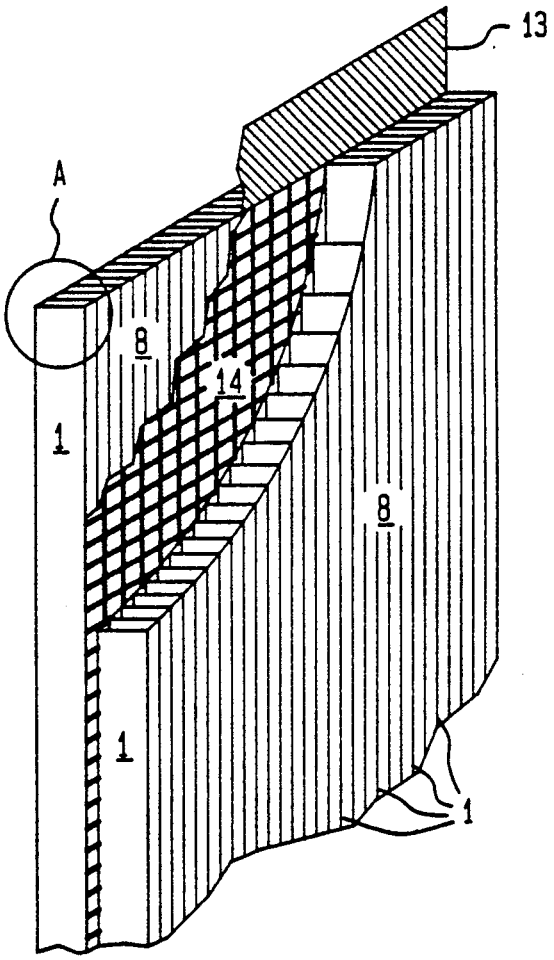

Exemplary embodiments of the invention, and in particular of the electrode elements, will now be described in further detail, referring to the drawings. Shown are:

FIG. 1: a cross section of an electrolysis cell according to the invention, with capillary gap electrodes;

FIG. 2: a detailed perspective view of two capillary gap electrodes as the cathode and anode, with a separating element between them;

FIG. 3: an enlarged detail A of FIG. 2 (scale: approximately 10:1);

FIG. 4: an enlarged detail A of FIG. 2 (scale: approximately 20:1);

FIG. 5: an electrode winding element, in a sectional view;

FIG. 6: a cross section of a capillary gap electrode comprising a plurality of electrode winding elements;

FIG. 7: an enlarged perspective view of electrode elements having a corrugated structure (scale: approximately 10:1);

FIG. 8: an enlarged perspective view of part of an actual capillary gap electrode (scale: approximately 10:1) made of a foil-like material folded on alternate sides;

FIG. 9: an enlarged detail B of the capillary gap electrode of FIG. 8;

FIG. 10: an enlarged perspective view of an electrode element with web-like profiled portions extending horizontally (on one side);

FIG. 11: an enlarged perspective view of an electrode element with web-like profiled portions extending horizontally (on both sides);

FIG. 12: an enlarged perspective view of an electrode element with local profiled portions (knob-like, of arbitrary direction);

FIG. 13: a detail of an electrode made of alternatingly arranged corrugated and unprofiled electrode elements;

FIG. 14: an enlarged, perspective view of an electrode element with beads disposed on both sides;

FIG. 15: an enlarged, perspective view of an electrode element with beads disposed on one side; and FIG. 16: a perspective detail view of two capillary gap electrodes as the cathode and anode, with a spacer element located between them (scale: approximately 1:1).

For the sake of clarity, FIGS. 2–16 show only the electrode elements, or the electrodes formed from them, which are used in an electrolysis cell. As can be seen from FIGS. 1–8 and 16, the electrode is made up of electrode elements 1, 1*a*, 28, 29, disposed parallel or quasi-parallel to one another, the thickness 3 and spacing 4 of which relative to one another are smaller by one to two orders of magnitude than in known electrodes.

According to the invention, the thickness 3 of the electrode elements 1, 1*a*, 1*b*, 1*c*, 1*d*, 15, 16, 28, 29, 30, 31 shown in FIGS. 2–16, which may be strips, foils or blades, is at most three times the mean bubble separation diameter. A gap 4 that brings about the capillary effect is provided between the electrode elements 1, 1*a*, 1*b*, 1*c*, 1*d*, 15, 16, 28, 29, 30, 31. The fixation of the electrode elements to one another can be effected for instance by a plurality of wires penetrating the electrode elements. Between the electrode elements, spacers may be disposed on the wires, to assure the capillary gap. The use of profiled electrode elements 1*a*, 1*b*, 1*c*, 1*d*, 15, 16, 28, 29, 30, 31 is more advantageous. These provisions make it simple to furnish a transportable, mountable capillary gap electrode that is readily adaptable in width.

The production of electrode elements from glass-metal foil strips made by the melt spinning process is particularly economical. They have smooth surfaces and edges and typically have a thickness of from 20 μm to 100μm. The preferred range of the electrode element thickness is about 40 μm; the width of the strips is approximately 5 mm. Using approximately 40 electrode elements per centimeter establishes a mean capillary gap 4 that is 200 μm in width. An electrode comprising a plurality of intrinsically highly flexible individual elements, in the form of a tight package, represents a structure that is mechanically heavily loadable and nevertheless is fully conforming to a flat surface. These surfaces need not meet stringent requirements in terms of flatness, rejection and the like.

FIG. 2 shows two electrodes 8 comprising electrode elements 1, one of which forms the cathode and the other the anode, with a separating element 7 such as a membrane between them, at a socalled zero spacing. The electrode structure allows a constant, small electrode spacing over a large surface area, this spacing being equivalent to the thickness of the separating element 7. The conformability of the electrode 8 furthermore assures uniform distribution of pressure over the separating element 7, which not only prevents it from being damaged but also does not impair the ion or electrolyte flow. The chambers that adjoin the electrode faces that are remote from the separating element 7 serve as degassing chambers for the electrolyte.

FIGS. 3 and 4 show the detail A of the electrode 8 of FIG. 1 on a larger scale. The electrode elements 1 used have a thickness 3 of approximately 30 μm and a width 5 of approximately 5 mm. The capillary gap 4 between the electrode elements is approximately equivalent to 200 μm. The faces 2 of the electrode elements 1 (see FIG. 4) represent the regions of high electrolytic reactivity. Their conversion per unit of surface area is approximately equivalent to that on the end faces of the electrode elements 1. These highly reactive faces 2 that substantially participate in the conversion extend transversely to the electrode plane at a depth that is approximately equivalent to the width of the gap 4. For the sake of greater clarity in the drawing, the width of the gap 4 has been exaggerated by a factor of 3 in comparison to the thickness and width of the electrode elements 1.

FIG. 5 shows another variant of an identically functioning electrode structure with a capillary gap. Spirally winding a pair of electrode elements comprising one smooth electrode element 29 and one electrode element 28 with a corrugated profile creates a quasi-parallel electrode structure. The definition of the desired capillary gap may also be effected by electrode elements profiled in some other way, which will be explained hereinafter.

An electrode portion comprising a plurality of electrode winding elements 53 is shown in FIG. 6. This electrode is bounded by a current lead 51. The electrode winding elements 53 are supported by a current distributor 52. Arbitrary, electrically adequately conductive and mechanically loadable constructions may be used as the current distributor. In the simplest case, a metal perforated plate may be used.

In FIG. 7, electrode elements la having a corrugated structure are shown. The axes 18 of their profiled shapes are inclined from the horizontal. By alternate-side folding of a foil 19, profiled in this way, about its folding axes 20, which are located in the vertical axis 17, the profiled parts of adjacent electrode elements 15, 16 come to rest on one another with a point-type contact. The perforations 21 disposed in the folding axis 20 have a width 22 that is oriented to the width of the capillary gap 4 or to the degree of deformation of the foil 19.

FIGS. 8 and 9 show details of such an electrode. The foil used has a thickness 3 of approximately 25 μm; the electrode elements 1*a* produced by alternate-side folding of the profiled foil 19 have a width 5 of approximately 5 mm and define the width of the gap 4 at approximately 200 μm. The faces 2 of the elements 1*a* again represent the regions of high electrolytic activity. Electrodes that are produced by perforation, profiling and folding can be produced economically, are easily manipulated and have a very uniform, finely arranged structure.

While the electrode element 1*b* shown in FIG. 10 has horizontally extending, web-like profiled portions 23 on only one side, web-like profiled portions 24', 24'' are disposed on both sides on the electrode element 1*c* of FIG. 11. The profiled portions 24' on one side, having the axis 26, do not extend parallel to the profiled portions 24'', having the axis 27, on the other side of the same electrode element 1*c*. This makes it possible to double the capillary gap between adjacent elements 1*c*. If electrode elements 1*c* of the kind shown in FIG. 11 are stacked, the intersecting profiled portions 24', 24'' have a point-type contact. However, it is also possible to arrange electrode elements 1*c* that are profiled on both sides in alternation with smooth, unprofiled electrode elements.

FIG. 12 shows knob-like profiled portions 25 of arbitrary direction, on one side of the electrode element 1*d*. However, it is also possible to provide profiled portions 25 on both sides of the electrode element 1*d*.

The profiled portions 23, 24', 24'', 25 as shown in FIGS. 10–12 can be produced by embossing tools. The production of electrode elements 1*b*, 1*c*, 1*d* by the melt spinning method to make glass-metal foil strips is especially economical. They usually have a thickness 3 of 20 μm to 100 μm and can be made in the desired width. To make the profiled portions 23, 24', 24'', 25, the surface of the roller is prepared accordingly.

FIG. 13 shows the cross section of a part of an electrode that comprises a package, with alternatingly arranged profile and unprofiled electrode elements 28, 29. The profiled portions of the electrode elements 28 have a corrugated structure, which results in a constantly varying capillary gap. Half the distance 34 between two adjacent, unprofiled electrode elements 29 can be considered to be the mean capillary gap width. The use of this package, because of the resilient action of the corrugated electrode elements 28, enables very simple variation of the width of the capillary gap 4. Accordingly, electrodes for various electrolytic processes can be made with one and the same kind of profiling.

FIGS. 14 and 15 show electrode elements 30, 31 with beadlike profiled portions 32 on both sides and on one side, respectively, the axes 36 of which extend orthogonally to the longitudinal axes of the electrode elements 30, 31. The electrode element 30 can be used in this form in combination with unprofiled electrode elements 1, 29. Combining these electrode elements 30, the beadlike profiled portions 32 of which have axes 36 that are inclined from the horizontal, with one another, leads to electrode structures that are quite similar to those of FIGS. 7 and 8.

The advantages of the electrode elements are that they can be joined, without separate spacers, to make compact, finely and uniformly structured packages. The capillary gap between adjacent electrode elements, defined by their profiled portions, assures an oriented gas transport and an intensive electrolyte exchange.

FIG. 16 shows two electrodes 8, one of which serves as the anode and the other as the cathode, with a wide-mesh spacer element 14 between them. The electrode structure allows a constant, small electrode spacing over a large surface area, and the spacing is equivalent to the thickness of the spacer element 14. The conformability of this electrode structure also assures that damage to the spacer element 14 is prevented. The electrodes 8 comprise electrode elements 1. The bulkhead 13 separates the gases in the upper region of the cell housing 40.

In FIG. 1, the basic structure of an electrolyte cell is shown. It has electrodes 8, which are formed of electrode elements according to the invention. To show the gas bubble distribution more clearly, the course of the gas bubbles is shown in simplified form in the form of bubble tracks 41, and the electrolysis cell has a relatively large electrode spacing and wide degassing chambers 10, 11. One of the essential prerequisites for the function of the electrolysis cell according to the invention is the electrodes 8 formed of the electrode elements according to the invention.

The arrows in FIG. 1 indicate the following: the feed of electrolyte 37; gas removal 38; and mixed gas removal 39.

The connections between the reaction chamber and degassing chambers 10, 1 are at most the size of one capillary gap; it is even better if these chambers are completely sealed off from one another, thus preventing any electrolyte transport between the electrodes 8 and the cell housing 40 from causing flow-dictated disturbances that might cause bubbles 6 to separate from the electrode reaction face and enter the reaction chamber 9.

A cell structure thus becomes available which hydraulically divides the electrolysis cell into a common reaction chamber 9 and separate degassing chambers 10, 11.

The purity of the gases generated depends definitively on the quality of the electrodes. The electrode spacing can also have an effect on the purity of the gases. To prevent coagulation of gas bubbles, a spacing of at least three times the bubble separation diameter must exist between the electrodes 8. Coagulation of gas bubbles leads to the formation of mixed gas in the reaction chamber 9.

Nevertheless, the aim should be to have the smallest possible electrode spacing, because that lowers the ohmic resistance. The electrolyte exchange between the degassing chambers 10, 11 and the reaction chamber 9 is more intensive the smaller (narrower) the reaction chamber 9 (or electrode spacing).

Gas bubbles 6 that nevertheless separate from the electrode 8 and migrate into the reaction chamber 9 cause the aforementioned insignificant formation of mixed gas. The bubbles cannot cause contamination of the pure gas, because they would coagulate with the bubbles formed there even before reaching the counter electrode. Their bubble diameter would then be too large for transport through a capillary gap 4 of the electrode 8 or in the sealing region with respect to the housing wall. The separation of the pure gases in the upper cell region is effected by means of one or more bulkheads 12, which are submerged below the surface of the liquid.

Optimal functioning of the electrode 6 is achieved if its structure is finely arranged and uniform. Such properties are best attained by tightly packed and uniformly profiled electrode elements 1, 1*a*, 1*b*, 1*c*, 1*d*, 28, 29, 30, 31.

The electrolysis cell, equipped with an electrode made of electrode elements according to the invention, functions as follows:

The large number of electrode elements 1, 1*a*, 1*b*, 1*c*, 1*d*, 28, 29, 30, 31 of the electrode 8 (approximately 40 to 50 electrode elements per centimeter) makes the electrode surface highly uniform. This means that the electric field is made sufficiently uniform, as is the current density load. Consequently, overloading and attendant premature wear of the electrocatalytic coating are avoided. Furthermore, this makes it possible to increase the surface area involved in the reaction to a value larger than the structural surface area. Under favorable conditions, the ratio of active reaction surface area to construction surface area can be approximately 2. The gas bubbles formed at the end faces and reactive faces 2 of the electrode elements 1, 1*a*, 1*b*, 1*c*, 1*d*, 28, 29, 30, 31 are located in the region of influence of the capillary gap . Because of the gas bubble formation, a pressure buildup occurs in the reaction chamber 9; this is the cause for the gas transport transverse to the electrode plane. In FIG. 4, the path of a gas bubble 6 through the capillary gap 4 between the electrode element 1 is shown. To the same extent, the electrolyte is exchanged between the degassing chamber 10, 11 and the reaction chamber 9. There are practically no gas bubbles that are freely movable in the electrolyte of the reaction chamber 9. They are moved along the electrode surface under the influence of the capillary effect, and are "sucked" into the capillary gap 4. This substantially reduces the electrical resistance of the electrolyte.

It should also be pointed out that the width 5 of the electrode elements 1 can be adapted to requirements in terms of the smallest possible ohmic voltage drop in the electrode material. The same is true for the dimensioning of the capillary gap 4, in order to achieve unimpeded hydraulic conditions in the reaction chamber of the electrolysis cell.

We claim:

1. An electrolysis cell for gas-evolving electrolytic processes, in particular for water and chlor-alkali electrolysis, using at least one electrode with electrode elements arranged parallel and forming the anode and cathode, characterized in that the electrode elements (1, 1*a*, 1*b*, 1*c*, 1*d*, 15, 16, 28, 29, 30, 31) have a thickness (3, 33) of up to three times the means bubble separation diameter, and have a capillary gap (4) relative to one another such that the direction of motion of the gas bubbles through the electrode (8) is substantially parallel to the direction of an electrical field formed between the reaction faces of the anode and cathode, and wherein the electrode elements (1, 1*a*, 1*b*, 1*c*, 1*d*, 15, 16, 28, 29, 30, 31) comprise profiled portions (23, 24', 24'', 25, 32) for defining the capillary gap (4).

2. The electrolysis cell of claim 1, characterized in that the electrode elements (1, 1*a*, 1*b*, 1*c*, 1*d*, 15, 16, 28, 29, 30, 31) are blades, strips or foils having a thickness (3, 33) of 450 micrometers at most.

3. The electrolysis cell of claim 2, characterized in that the electrode elements (1, 1*a*, 1*b*, 1*c*, 1*d*, 15, 16, 28, 29, 30, 31) are produced from a glass-metal foil strip.

4. The electrolysis cell of claim 1, characterized in that the width (5) of the electrode elements (1, 1*a*, 1*b*, 1*c*, 1*d*, 15, 16, 28, 29, 30, 31) is at least ten times the width of the capillary cap (4).

5. The electrolysis cell of claim 4, characterized in that the electrode elements (1, 1*a*, 1*b*, 1*c*, 1*d*, 15, 16, 28, 29, 30, 31) are produced from a glass-metal foil strip.

6. The electrolysis cell of claim 1, characterized in that the electrode elements are a component of a planar structure folded on alternate sides, which have perforations (21) in the region of its folding edges (20).

7. The electrolysis cell of claim 6, characterized in that
the perforations (21) are uniformly distributed.

8. The electrolysis cell of claim 6,
characterized in that
the electrode elements (1, 1*a*, 1*b*, 1*c*, 1*d*, 15, 16, 28, 29, 30, 31) are produced from a glass-metal foil strip.

9. The electrolysis cell of claim 1,
characterized in that
the profiled portions (23, 24′, 24″, 25) are embossed portions of material.

10. The electrolysis cell of claim 1,
characterized in that
the profiled portions (23, 24′, 24″, 32) have a web-like structure extending transversely to the electrode plane.

11. The electrolysis cell of claim 1,
characterized in that
the profiled portions (25) are embodied as knob-like or button-like.

12. The electrolysis cell of claim 1,
characterized in that the electrode elements (1, 1*a*, 1*b*, 1*c*, 1*d*) laterally defining the electrode (8), and the lower closure of the electrode (8) toward the inner wall of the cell housing (40) is sealed off, except for at most a gap corresponding to the capillary gap (4) between the electrode elements (1, 1*a*, 1*b*, 1*c*, 1*d*, 15, 16, 28, 29, 30, 31), and the degassing chambers (10, 11) are separated in a gas-tight manner in the upper cell region, at least up to the surface of the electrolyte, by a bulkhead (12, 13).

13. The electrolysis cell of claim 12,
characterized in that
the spacing between the anode and cathode is defined by one or more electrolyte-proof dielectric spacer elements (14), which have a net-like, honeycomb, or woven structure.

14. The electrolysis cell of claim 1,
characterized in that
the electrode elements (1, 1*a*, 1*b*, 1*c*, 1*d*, 15, 16, 28, 29, 30, 31) are produced from a glass-metal foil strip.

15. An electrolysis cell, having
at least one electrode with electrode elements, arranged generally parallel to each other, serving as anode and cathode,
for a gas-evolving electrolysis process in which a bubble of gas evolved, upon growing to a characteristic means separation diameter, separates from its nucleus or initial formation point and moves by adhesion along a surface of said at least one electrode,
characterized in that
the electrode elements (1, 1*a*, 1*b*, 1*b*, 1*d*, 15, 16, 28, 29, 30, 31) have a thickness (3, 33) of up to three times said mean bubble separation diameter;
have a capillary gap (4) relative to one another dimensioned such that the direction of motion of the gas bubbles through the electrode (8) is substantially parallel to the direction of an electrical field formed between reaction faces of the anode and cathode; and
the electrode elements (28, 29) are together wound in a spiral configuration.

16. The electrolysis cell of claim 15,
characterized in that
the electrode elements (1, 1*a*, 1*b*, 1*c*, 1*d*, 15, 16, 28, 29, 30, 31) are produced from a glass-metal foil strip.

* * * * *